US008281444B2

(12) United States Patent
Rosen et al.

(10) Patent No.: US 8,281,444 B2
(45) Date of Patent: Oct. 9, 2012

(54) CLEANING PIG

(75) Inventors: Patrik Rosen, Meppen (DE); Hubert Linder, Emsbüren (DE); Frank Fielers, Lingen (DE)

(73) Assignee: Rosen Swiss AG, Stans (CH)

( * ) Notice: Subject to any disclaimer, the term of this patent is extended or adjusted under 35 U.S.C. 154(b) by 690 days.

(21) Appl. No.: 12/161,037

(22) PCT Filed: May 30, 2006

(86) PCT No.: PCT/EP2006/005117

§ 371 (c)(1),
(2), (4) Date: Jul. 16, 2008

(87) PCT Pub. No.: WO2007/087833

PCT Pub. Date: Aug. 9, 2007

(65) Prior Publication Data

US 2010/0162503 A1 Jul. 1, 2010

(30) Foreign Application Priority Data

Jan. 20, 2006 (DE) ..... 20 2006 000 969 U

(51) Int. Cl.
*B08B 9/04* (2006.01)

(52) U.S. Cl. ..... 15/104.061; 134/8

(58) Field of Classification Search ..... 15/104.061, 15/104.05; 134/8; *B08B 9/04*
See application file for complete search history.

(56) References Cited

U.S. PATENT DOCUMENTS

| | | | | |
|---|---|---|---|---|
| 3,600,736 | A * | 8/1971 | Smith et al. | 15/104.061 |
| 3,708,819 | A * | 1/1973 | Breston | 15/104.061 |
| 5,903,946 | A | 5/1999 | Collins et al. | |
| 6,190,090 | B1 | 2/2001 | Campbell et al. | |
| 6,755,916 | B1 * | 6/2004 | Pruett | 134/8 |
| 6,944,902 | B1 * | 9/2005 | Richter et al. | 15/104.061 |

FOREIGN PATENT DOCUMENTS

| | | | |
|---|---|---|---|
| DE | 74 34 424 | U1 | 1/1975 |
| DE | 296 13 522 | U1 | 1/1998 |
| GB | 1280102 | * | 7/1972 |
| GB | 1280102 | A | 7/1972 |

* cited by examiner

*Primary Examiner* — Monica Carter
*Assistant Examiner* — Stephanie Newton
(74) *Attorney, Agent, or Firm* — Gudrun E. Huckett

(57) ABSTRACT

A cleaning pig for a pipeline for long-distance transportation of a fluid material is advanced in the pipeline in a travel direction by the fluid material transported in the pipeline. The cleaning pig has a pig body and two collars connected to the pig body and spaced apart from one another. The pig body and the collars fill a pipe cross-section of the pipeline. An intermediate space is delimited between the two collars. A pressure opening is arranged at a trail end of the pig body in the travel direction. A pressure conduit connects the pressure opening to the intermediate space. A suction device is arranged in the intermediate space. A suction outlet is connected by a suction conduit to the suction device. The pressure conduit is connected to at least one jet opening directed with a jet action against an inner wall of the pipeline.

6 Claims, 2 Drawing Sheets

CLEANING PIG

BACKGROUND OF THE INVENTION

The invention concerns a cleaning pig for pipelines for long-distance transportation of fluid materials, comprising a pig body that fills the pipe cross-section by means of at least two collars spaced apart from one another in a longitudinal direction of the pig and that is advanced in the pipeline in a predetermined travel direction by the fluid material transported in the pipeline. Cleaning pigs of this kind are provided for pipelines before start of operation of the line or also for periodic cleaning and maintenance, namely for long-distance gas pipelines as well as pipelines for transporting liquids such as oil, water or any type of liquid chemical product. Contaminants or deposits on the pipe walls can be removed in many cases by the stripping for dragging action of the collars and optionally by brushes that are additionally pressed against the pipe wall and can be transported away by the gas or the liquid that also moves the pig. However, there are situations in which the action of collars or brushes on the deposits on the pipe walls remains unsatisfactory.

In particular in some long-distance gas pipelines dust deposits are found on the pipe walls that remain essentially adhered to the walls when a pig passes through and partially even cause great wear on the collars of the pig as a result of a highly abrasive action. Accordingly, the stripping function of the collars is even further reduced.

It is therefore an object of the invention to provide a cleaning pig that can be used in the same way as conventional cleaning pigs and that can be moved by means of the fluid material to be transported, that however in case of special deposits on the pipe walls such as dust exhibits an improved cleaning action and a reduced wear on the pig in particular in the areas of its collars.

SUMMARY OF THE INVENTION

According to the invention this object is solved by a pig of the aforementioned kind in that the pig has at least one pressure opening at the trail end that, by means of a pressure conduit, is connected to at least one jet opening that opens in an intermediate space between the collars and is directed against the inner wall of the pipeline. It has been found that by means of a jet action directed through a jet opening against the pipe wall it is prevented the particles remain adhered to the pipe wall and that the collars (or even the brushes) move across the particles without the particles becoming detached. Such a jet opening can be supplied with the fluid medium through a pressure opening at the tail end so that carrying a separate energy source for this purpose is not required. The thus provided passage of the fluid material through the cleaning pig also results in a reduction of the travel speed of the pig relative to the fluid material in the pipeline but can be designed reliably in such a way that the cleaning pig carries out an advancing movement. The slower speed of the cleaning pig relative to the surrounding fluid material in the pipeline prevents moreover a collection of dirt particles in the area of the pig; such collection has been observed in the past in connection with the purely mechanical cleaning action provided by the collars or brushes.

Preferably, the dirt that has been removed by the jet opening from the pipe wall is sucked off and transferred by the pig in the forward direction. This is achieved expediently by a suction device that is connected by means of a suction conduit to a suction outlet that is arranged before the pressure opening in the travel direction.

Advantageously, it is provided that the blow opening in the travel direction opens before the suction device so that within the pig between the collars a rearward flow direction from the jet opening to the suction device is provided that corresponds to the advancing movement of the pig.

The suction outlet can be connected to a jet enhancer or the like fluidic suction generator that extends through the pig in the longitudinal direction in order to enhance the suction action by an increased suction effect. Similar effects can be achieved by means of e.g. a blaster or a venturi tube.

BRIEF DESCRIPTION OF THE DRAWINGS

Three embodiments of the object of the invention are illustrated in the drawing and will be disclosed in the following in more detail. The drawing shows in.

DESCRIPTION OF PREFERRED EMBODIMENTS

Figure 1:
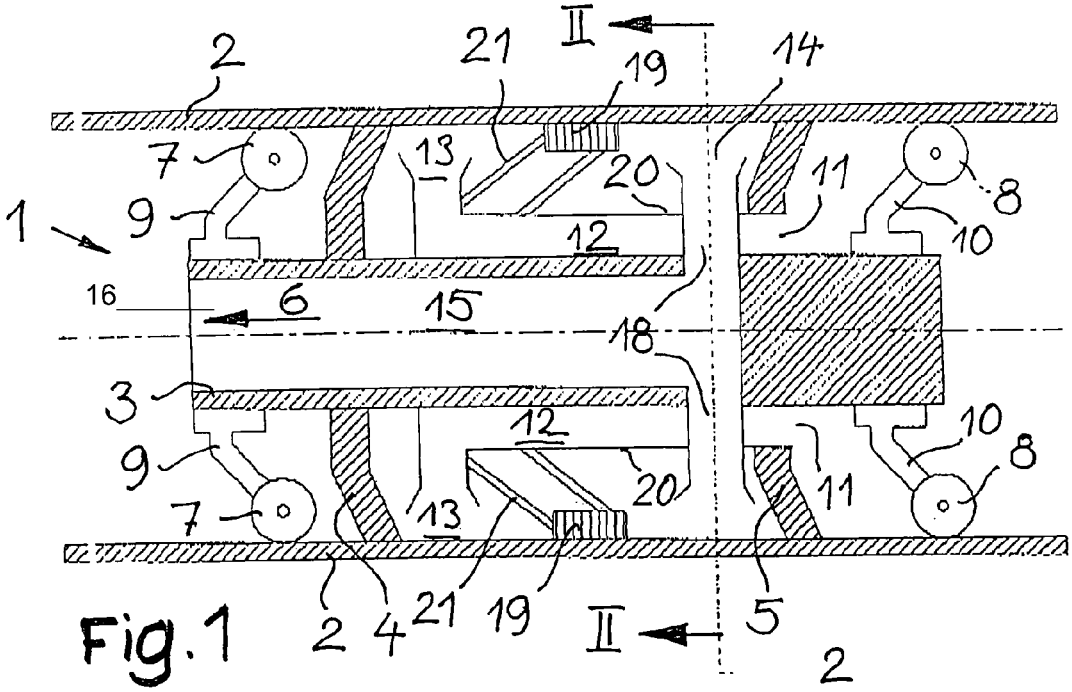
FIG. 1 a longitudinal section of a pig in a pipe.
Figure 2:
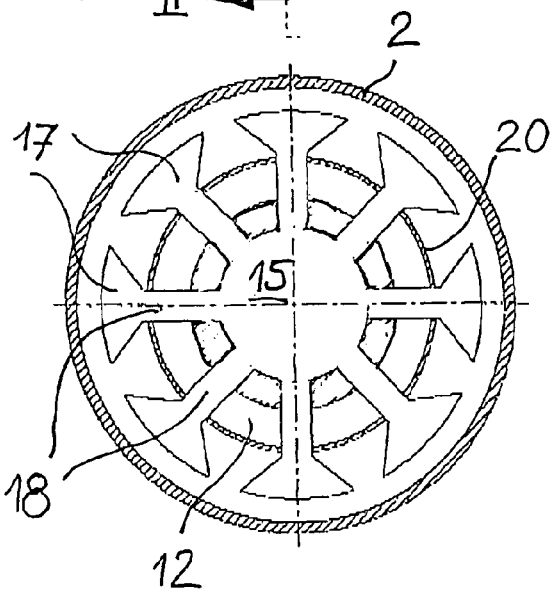
FIG. 2 a section along section line II-II in FIG. 1.

In FIG. 1, a cleaning pig referenced as a whole by 1 is shown in operation in a pipeline 2 that is, for example, a gas pipeline but basically can be also a liquid pipeline e.g. for long distance transportation of oil, water or liquid chemicals. Pipelines for long distance transportation of gas or crude oil are typically divided into long sections of, on average, 70 kilometers but can also have sections of several hundred kilometers through which cleaning pigs—like separating pigs for delimiting charges of fluid materials to be sequentially conveyed in the pipeline or also measuring pigs for monitoring the pipeline 2—must pass before they are stopped in a station, removed and checked.

The cleaning pig of the kind considered in this context has usually a supporting pig body 3 from which at least two spaced-apart collars 4, 5, consisting of an elastic but highly wear-resistant material, such as polyurethane, project radially outwardly so as to rest against the inner wall of the pipeline. These collars 4, 5, on the one hand, close off the pipeline cross-section to such an extent that the cleaning pig 1 "cruises" together with the fluid material transported in the pipeline, i.e., experiences at the rear an adequate pressure in comparison to the front end in the travel direction so that it overcomes the friction on the pipeline wall as well as the inertia of mass of the pig and also possible gravitational effects at inclined sections of such a pipeline.

The collars 4, 5, as is known in the art, are essentially disk-shaped and in the present case of the cleaning pig 1, relative to the travel direction indicated by the arrow 6, are slightly dished and outwardly fleeing in order to reduce the gliding movement of the collars relative to the inner wall of the pipeline and in order to improve the sealing contact provided by the rearward pressure of the fluid material.

While in simple pig configurations the collars also provide the centering and supporting action for the pig 1 relative to the inner wall, in the present case wheels 7 are provided on the lead end of the pig 1 and wheels 8 on the trail end of the pig 1 that extend toward the inner side of the pipeline 2 on adequately yielding wheel supports 9 and 10 and in this way support and center the pig.

Such a centering and supporting action is in particular preferred when a great wear of the collars 4, 5 for large section lengths of the pipeline 2 and in particular for highly abrasive coatings on the inner side of the inner walls of the pipeline are to be expected. This can be the case, for example, in long-distance gas pipelines with dust deposits in the pipeline that are engaged and carried away only unsatisfactorily by the collars and cause great wear on the collars so that their contact on the pipeline will become defective. In this way, the cleaning effect as well as advancing of the cleaning pig become questionable.

The cleaning pig 1 has a special device that serves for detaching and removing deposits, in particular, dust-like deposits from the pipeline. In this respect, the pig 1 has an annular pressure opening 11 on the trail end that is cut out between the pig body 3 and the collar 5 and that is connected via pressure conduit 12 in the form of an annular chamber to a jet opening 13 that is directed against the inner wall of the pipeline 2. The jet opening can be designed like an annular radially outwardly oriented opening. It is understood that alternatively also a ring arrangement of individual openings can be provided. Instead of having a slightly widening shape, the jet opening 13 can be designed to have a narrowed shape as a jet in order to direct a pointed jet onto the inner wall of the pipe.

The deposits that are removed from the inner wall of the pipe by means of the jet opening 13 are removed by a suction device 14, arranged in the travel direction behind the jet opening 13, by means of a stream of the fluid material and are transported by means of a suction conduit 15 extending centrally and forwardly through the pig body 3 to a suction outlet 16 at the lead end. In this way, a flow-through action through the cleaning pig 1 from the pressure opening 11 to the suction outlet 16 results wherein the suction outlet in the travel direction is arranged before the pressure opening. However, the flow passing through the area between the collars 4, 5 in the travel direction is directed toward the rear. This facilitates pick-up of the removed deposits when, for example, in a gas pipeline a gas flow of 5 to 10 m/s is adjusted and the cleaning pig in comparison travels at a speed of 1 m/s or less m/s.

The suction device 14 is formed by a ring arrangement of suction elements 17 that are distributed annularly about the circumference of the pig and are connected to the suction conduit 15 by means of radial connectors 18 that pass through the pressure conduit 12. It is understood that the suction elements 17 can also be formed as an annular continuous suction device.

For assisting the removal of deposits from the pipeline 2 brushes can be arranged between the collars on the pig body 3; in the illustrated embodiment they are mounted on an outer wall 20 of the pressure conduit 12 by means of a parallelogram linkage 21 that also effects an elastic pressure action in the outward direction. These brushes 19 are also arranged in the travel direction in front of the suction device 14 so that the suction device 14 with the flow oriented toward the rear will also pick up the deposits that have been removed by the brushes 19.

Figure 3:
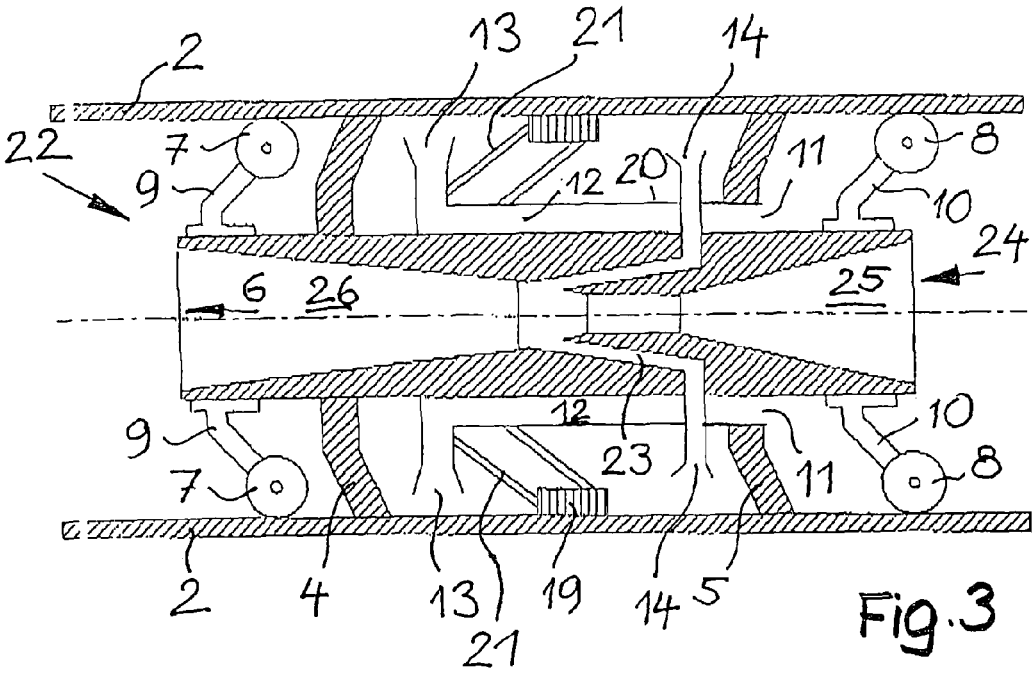
FIG. 3 a longitudinal section of a further pig.

FIG. 3 shows an embodiment of a cleaning pig 22 that with regard to different elements corresponds to the preceding one wherein the coinciding elements are identified with the same reference numerals as in FIG. 1 and are not explained again in the following. The special feature of this embodiment resides in an enhanced suction action. Instead of the simple centrally forwardly extending suction conduit 15, the suction device 14 is connected by means of suction conduit 23 to a venturi tube 24 or a similarly acting fluidic suction generating device, for example, in the form of a jet pump or a blaster. The venturi tube 24 has an intake 25 that narrows like a jet and an outlet 26 that widens like a diffusor and is suitable with an intermediately positioned narrowed area of high flow rate and low pressure to provide the desired high suction action for the suction device 14. This increases also the flow through the area between the collars from the jet opening 13 to the suction device 14 and improves thus the removal of detached floating deposit particles. Even though the flow rate required for obtaining the suction performance causes a slowdown of the movement of the cleaning pig 22 relative to the surrounding gas or fluid stream and is to be limited so as to provide reliable advancing of the cleaning pig 22, it provides otherwise, as a result of the great speed difference between the fluid material transported in the pipeline and the cleaning pig, that deposits that have been detached are transported away so that they cannot collect in the pig area; such collection has been observed in conventional cleaning pigs operating only with collars.

Figure 4:
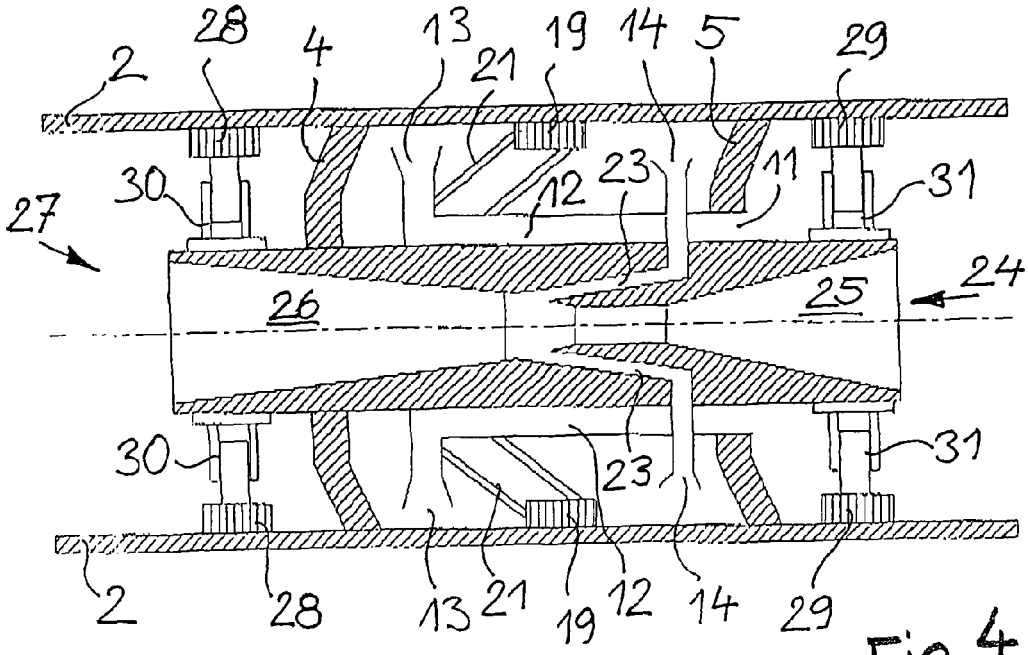
FIG. 4 a longitudinal section of a pig according to a third embodiment.

A further variant of a cleaning pig 27 according to FIG. 4 has a configuration that is substantially the same as that of the cleaning pig 22 according to FIG. 3 so that individual elements are also identified with same reference numerals. The cleaning pig 27 differs from the cleaning pig 22 in that the wheels 7, 8 for centering and supporting the cleaning pig 27 have brushes 28 in the leading area of the pig and brushes 29 in the trailing area, each outside of the longitudinal area that is delimited by the collars 4, 5; the brushes, arranged in a ring-shaped distribution about the circumference of the pig, are pressed with a springy action against the inner wall of the pipeline 2 and in this way develop an additional cleaning action. In this connection, the brushes 28, 29 are supported by movable supports 30, 31 in a yielding way in order to be able to adjust to the pipeline in the sense of providing uniform pressure in case of wear or in case of changing configurations of the inner pipeline cross-section.

What is claimed is:

1. A cleaning pig for a pipeline for long-distance transportation of a fluid material, wherein the cleaning pig is advanced in the pipeline in a predetermined travel direction by the fluid material that is transported in the pipeline; the cleaning pig comprising:

a pig body;

at least two collars connected to the pig body and spaced apart from one another in a longitudinal direction of the pig body, wherein the at least two collars fill a pipe cross-section of the pipeline and wherein between the at least two collars an intermediate space is delimited;

at least one pressure opening arranged at a trail end of the pig body in the travel direction;

at least one suction device arranged in the intermediate space;

at least one suction outlet connected by a suction conduit to the at least one suction device, wherein the at least one suction outlet is arranged before the at least one pressure opening in the travel direction;

at least one jet opening that opens into the intermediate space and is directed with a jet action against an inner wall of the pipeline;

a pressure conduit connected to the at least one pressure opening and communicating with the at least one jet opening;

a venturi tube that passes in the longitudinal direction through the pig from the trail end to a leading end of the pig body, wherein the venturi tube has an intake that is separate from the at least one pressure opening and located in the travel direction at the trail end outside of the intermediate space;

wherein the at least one suction outlet is connected to the venturi tube.

2. The cleaning pig according to claim 1, wherein the at least one jet opening is arranged before the suction device in the travel direction.

3. The cleaning pig according to claim 1, wherein several of the at least one jet opening are arranged in a ring arrangement extending circumferentially about the pig body and wherein the pressure conduit is connected to the ring arrangement.

4. The cleaning pig according to claim 1, wherein the at least one jet opening is an annular nozzle extending circumferentially about the pig body.

5. The cleaning pig according to claim 1, wherein the at least one suction device is annular and extends circumferentially about the pig body.

6. The cleaning pig according to claim 1, wherein the at least one suction device is comprised of suction elements that are arranged in a ring arrangement, wherein the suction elements are distributed circumferentially about the pig body.

* * * * *